US009136054B1

(12) United States Patent
Xiong et al.

(10) Patent No.: US 9,136,054 B1
(45) Date of Patent: Sep. 15, 2015

(54) REDUCED LEAKAGE INDUCTANCE TRANSFORMER AND WINDING METHODS

(75) Inventors: Wei Xiong, Madison, AL (US); Donald Folker, Madison, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 341 days.

(21) Appl. No.: 12/951,990

(22) Filed: Nov. 22, 2010

(51) Int. Cl.
*H01F 21/02* (2006.01)
*H01F 27/28* (2006.01)
*H01F 27/30* (2006.01)
*H01F 29/02* (2006.01)

(52) U.S. Cl.
CPC ..... *H01F 29/02* (2013.01)

(58) Field of Classification Search
CPC ..... H01F 27/303
USPC ..... 336/126, 128, 145, 147, 170, 173, 182, 336/183, 185, 199, 206, 220
See application file for complete search history.

(56) References Cited

U.S. PATENT DOCUMENTS 3,895,335 A * 7/1975 Manimalethu ..... 336/183
4,524,341 A 6/1985 Owen
5,500,632 A 3/1996 Halser
5,543,773 A 8/1996 Evans et al.
6,580,334 B2 6/2003 Simbraeger et al.
6,822,549 B2 11/2004 Wolfgram
7,148,779 B2 12/2006 Wolfgram
7,982,576 B2 * 7/2011 Feng et al. ..... 336/232
2003/0102948 A1 * 6/2003 Wolfgram ..... 336/182
2004/0061584 A1 * 4/2004 Darmann ..... 336/182
2006/0132272 A1 * 6/2006 Kitahara et al. ..... 336/192

* cited by examiner

*Primary Examiner* — Elvin G Enad
*Assistant Examiner* — Ronald Hinson
(74) *Attorney, Agent, or Firm* — Patterson Intellectual Property Law, P.C.; Mark J. Patterson; Jerry Turner Sewell

(57) ABSTRACT

A transformer apparatus provides a primary winding and a secondary winding. The primary winding is divided into multiple primary winding layers. Each primary winding layer includes a number of primary layer turns. The secondary winding includes several secondary winding layers. In some embodiments, the transformer includes alternating primary and secondary winding layers wound around a bobbin structure. At least one secondary winding layer is positioned adjacent a primary winding layer. In some embodiments, the number of primary layer turns in each primary winding layer is equal to the total number of primary winding turns divided by the number of primary winding layers. A method of winding a transformer is also provided.

2 Claims, 4 Drawing Sheets

REDUCED LEAKAGE INDUCTANCE TRANSFORMER AND WINDING METHODS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to magnetic circuit components, such as transformers and inductors. More particularly, the present invention relates to devices and methods for reducing leakage inductance in magnetic components.

Power converters are used in a variety of applications in electronic devices such as lighting ballasts and drivers for high voltage lamps. Historically, conventional high voltage power converters can include an isolated transformer. In some applications such as flyback transformers and traditional or modified buck-boost type power converters, the isolated transformer can act as a bridge between primary and secondary circuits. In some applications, the primary circuit includes a voltage source and can be referred to as an input circuit, and the secondary circuit includes a device to be powered and can be referred to as an output circuit. The secondary circuit can also be coupled to a device to be powered by the power converter. Conventional transformers of this type can be used in high voltage applications where the transformer acts as a step-up or step-down transformer and can include a rectifier or an inverter. In some conventional applications, transformers of this type are used for increasing an input voltage to a much higher output voltage. For example, conventional plasma lamp power supplies and high voltage ballasts for other types of conventional lighting driver circuits include isolated transformers.

One problem associated with conventional power converters that utilize isolated transformers is leakage inductance. Leakage inductance can occur when the windings in the primary and secondary transformer coils are either improperly positioned, improperly insulated, or make improper contact. Other defects in one or more windings, in the bobbin structure, or in the inter-layer insulation can also cause leakage inductance. Conventional transformers known in the art are particularly susceptible to leakage inductance because of their winding configurations. The effects of leakage inductance can include reduced magnetic flux between primary and secondary coils and inefficient power regulation in high voltage applications. Leakage inductance also causes power loss and can reduce transformer efficiency.

Because an isolated transformer is generally formed between the input and output circuits in some conventional power supplies, managing leakage inductance is important for maximizing power conversion efficiency and for providing proper power regulation to the output circuit. For example, if the leakage inductance is too high in a flyback converter, switching transitions are slowed down, energy is lost, and in some applications a high voltage ring can occur when the main switch is turned off, causing a large voltage stress on the switch and an undesirable power loss. Such stress can cause a switch to fail or can permanently damage other circuit components.

Others have attempted to solve the problems associated with leakage inductance in high voltage power converters, switching power supplies, and specifically in flyback converters and flyback transformers, by splitting the primary and secondary windings into discrete insulated layers and interleaving the layers. The conventional layer interleaving technique mitigates leakage inductance in some applications. However, in other applications, especially where the number of primary turns is greater than the number of secondary turns, or vice versa, conventional interleaving configurations become impractical and do not adequately control leakage inductance.

BRIEF SUMMARY OF THE INVENTION

One aspect of the present invention provides a magnetic component apparatus for an electronic circuit. The apparatus includes a conductive winding assembly having a primary winding and a secondary winding. The conductive winding assembly forms a total number of winding layers (N), wherein the total number of winding layers (N) includes a plurality of alternating primary and secondary winding layers. The primary winding includes a total number of primary winding turns ($N_P$), wherein the total number of primary winding turns ($N_P$) is split over multiple primary winding layers, the number of primary winding layers being ($N_{layer}$). Each primary winding layer includes a number of primary layer turns equal to ($N_P/N_{layer}$). The secondary winding includes a plurality of secondary winding layers, and each one of the plurality of secondary winding layers is positioned adjacent to a primary winding layer.

Another aspect of the present invention provides a method of winding a transformer having a primary winding including a total number of primary winding turns ($N_P$) and a secondary winding with a number of secondary winding turns ($N_S$), wherein the primary winding includes ($N_{layer}$) primary winding layers. The method includes the steps of: (a) winding a first conductive wire a number of turns ($N_S$) around a coil former to form a first layer; and (b) winding a second conductive wire a number of turns ($N_P/N_{layer}$) around the first layer forming a second layer.

Yet another aspect of the present invention provides a method of winding a transformer having a total number of winding layers equal to (N), the transformer including a primary winding having a total number of primary winding turns equal to ($N_P$), the transformer including a secondary winding having a total number of secondary winding turns equal to ($N_S$), the primary winding being divided into ($N_{layer}$) primary winding layers. The method includes the step of positioning alternating primary and secondary winding layers around a bobbin structure, wherein each primary winding layer includes ($N_P/N_{layer}$) primary layer turns and each secondary winding layer includes ($N_S$) secondary layer turns.

DETAILED DESCRIPTION OF THE INVENTION

Figure 1:
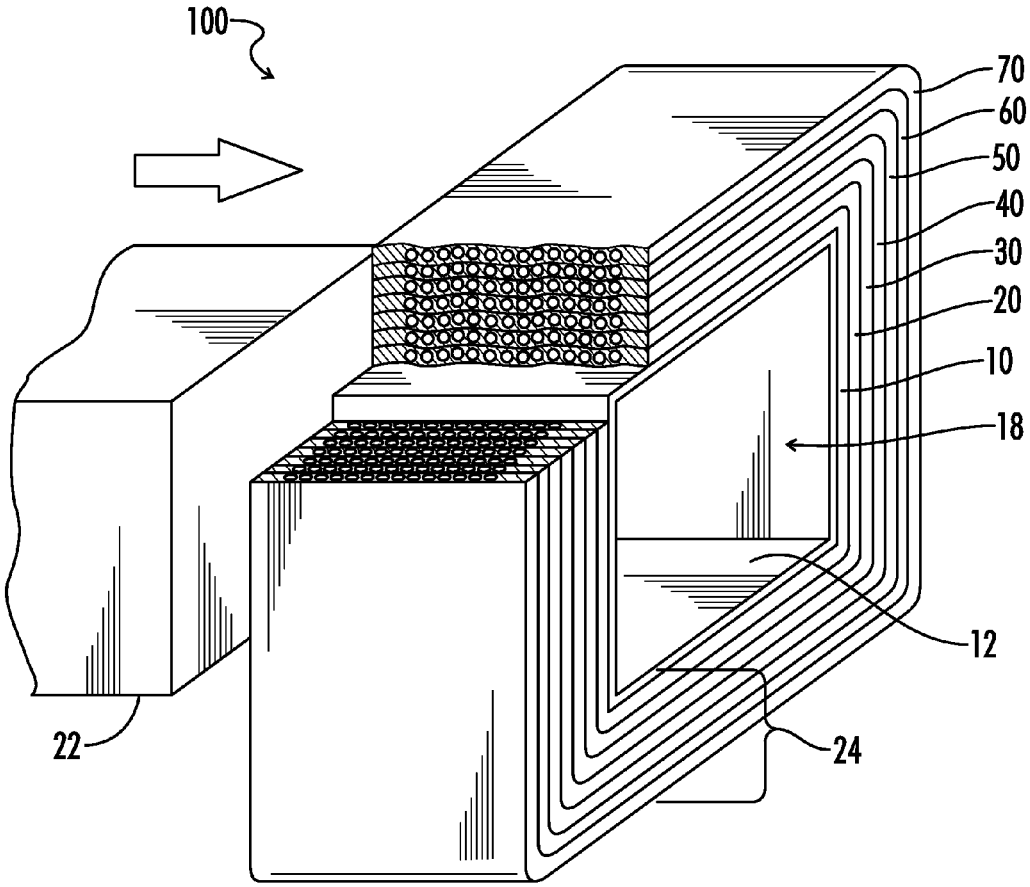
FIG. 1 is a partially broken away perspective view of one embodiment of a transformer, or a magnetic component, in accordance with the present invention.

Referring now to the drawings, a transformer 100 is generally illustrated in one embodiment in FIG. 1. Transformer 100 in some embodiments not shown may include a pair of coupled inductors of the type found generally in flyback transformers or flyback converters for bridging a primary loop and a secondary loop. The pair of inductors can include a first inductor on the first loop and a second inductor on the second loop. Additionally, transformer 100 can include a bobbin-wound step-up or step-down transformer including multiple conductive windings positioned around a bobbin structure 12. Bobbin structure 12 in some embodiments defines an interior cavity 18 shaped for receiving a core 22. Although a bobbin structure with a rectangular profile is illustrated in FIG. 1, it will be readily apparent to those of skill in the art that bobbin structures with various other profiles can be used in accordance with the present invention. In some embodiments, core 22 includes a ferrite material. Core 22 can include a standard or modified E-core, an I-core, a U-core, a laminated metal alloy core, or another type of suitable core for a transformer. In some embodiments, transformer 100 includes a bobbinless transformer having no bobbin structure 12 or coil former.

As seen in FIG. 1, transformer 100 includes a plurality of layers. Each layer typically includes one or more turns of a conductive wire. In some embodiments, one or more layers includes only one turn of a conductive wire, forming a single-turn winding. The wire used in each layer can have different dimensions and/or material compositions, including but not limited to copper, nickel, iron, alloys thereof or other metal or nonmetal electrically conducting materials known in the art. Additionally, each conductive wire can include a dissimilar material coating or sheath that can include an electrical and/or thermal insulator in some applications. In some embodiments, first layer 10 can include a first number of turns of a first wire having a first diameter, and second layer 20 can include a second number of turns of a second wire having a second diameter. The first and second diameters can be equal in some embodiments and can be unequal in other embodiments. Similarly, the first and second number of turns can be equal in some embodiments, and in other embodiments can be unequal.

In some embodiments, transformer 100 is a high voltage transformer of the type used in high voltage power supply applications, such as generating a voltage output signal at a desired frequency. In some applications, transformer 100 is a flyback transformer or a line output transformer. Transformer 100 can include a step-up transformer adapted to transform a first voltage input to a second voltage output, where the second voltage is greater than the first voltage. Transformer 100 can be combined with a switch mode power supply (SMPS) that includes one or more switches to provide power at a desired frequency. In some embodiments, a switch connected to transformer 100 is controlled by one or more pulse width modulators (PWMs) connected to the input or output circuits.

Referring further to FIG. 1, transformer apparatus 100 includes a conductive winding assembly 24. Conductive winding assembly 24 includes a primary winding and a secondary winding forming a plurality of winding layers. A primary winding is generally defined as a coil of conductive wire included as part of a circuit that induces a current in a second coil, or secondary winding, positioned near the primary winding. For example, a primary winding may include a conductive wire wound a first number of turns A around a ferrite core. A secondary winding can be wound a second number of turns B around the same ferrite core. By passing an electric current through the primary winding, a corresponding electric current will be induced through the wire forming the secondary winding. The induced electric current present in the secondary winding is due in part to the magnetic field resulting from the flow of electric current through the primary winding. The amount of current induced in the secondary winding will be related to the ratio of the first number of turns A to the second number of turns B, along with other factors.

Conductive winding assembly 24 includes a total number of winding layers (N). The total number of winding layers (N) for example in FIG. 1 equals seven. It will be readily appreciated by those of skill in the art that the total number of winding layers (N) can be at least two. In theory, the total number of winding layers (N) has no upper limit, but in practice an upper limit is reached at around several thousand. The total number of winding layers (N) includes a plurality of individual winding layers. For example, as seen in FIG. 1, a first layer 10 is disposed about bobbin structure 12. A second layer 20 is disposed around first layer 10. A third layer 30 is disposed around second layer 20. A fourth layer 40 is disposed around third layer 30. A fifth layer 50 is disposed around fourth layer 40. A sixth layer 60 is disposed around fifth layer 50. A seventh layer 70 is disposed around sixth layer 60. In other embodiments, additional layers can be disposed around each previous layer on bobbin structure 12 in addition to those illustrated in FIG. 1.

In some embodiments, the total number of winding layers (N) includes a plurality of alternating primary and secondary winding layers. For example, in some embodiments, first winding layer 10 is part of the primary winding, and second winding layer 20 is part of the secondary winding. Third winding layer 30 is also part of the primary winding layer and is electrically connected to first winding layer 10. Similarly, fourth winding layer 40 is part of the secondary winding and is electrically connected to second winding layer 20. Additionally, fifth winding layer 50 is also part of the primary winding is electrically connected to both first winding layer 10 and third winding layer 30. Also, sixth winding layer 60 is part of the secondary winding and is electrically connected to second winding layer 20 and fourth winding layer 40. Finally, in some embodiments, seventh winding layer 70 is part of the primary winding, and seventh winding layer 70 is electrically connected to first winding layer 10, third winding layer 30 and fifth winding layer 50.

In some other alternating primary and secondary winding layer embodiments, the first winding layer 10 includes a winding layer that is part of the secondary winding, i.e. a current is induced in first winding layer 10. In these embodiments, second winding layer 20 is part of the primary winding. Third winding layer 30 is part of the secondary winding and is electrically connected to first winding layer 10. Also, fourth winding layer 40 is part of the primary winding and is electronically connected to the second winding layer 20. Additionally, fifth winding layer 50 is part of the secondary winding and is electrically connected to the first winding layer 10 and the third winding layer 30. Further, sixth winding layer 60 is part of the primary winding and is electrically connected to the second winding layer 20 and the fourth winding layer 40. Finally, seventh winding layer 70 is part of the secondary winding and is electronically connected to the first winding layer 10, the third winding layer 30 and the fifth winding layer 50. First layer 10 can include either a primary winding layer or a secondary winding layer.

Figure 3:
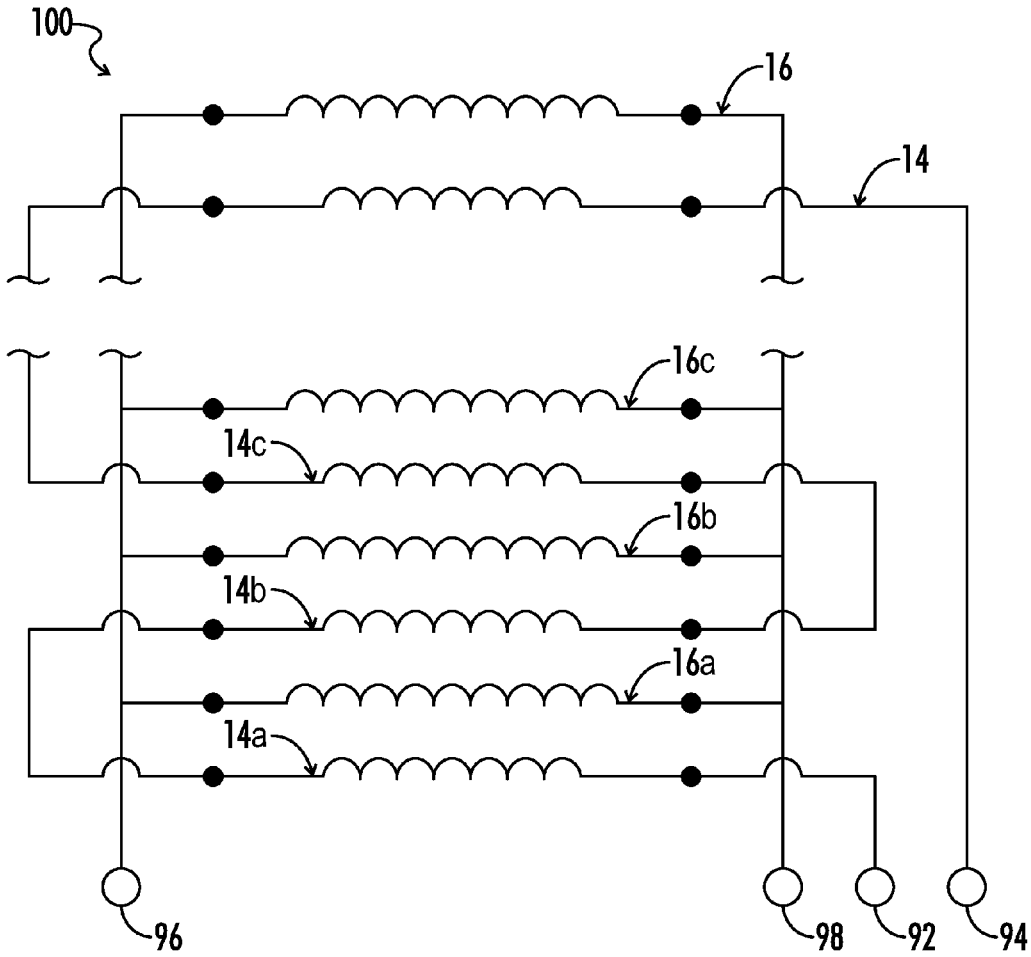
FIG. 3 illustrates a circuit diagram of an embodiment of a transformer apparatus in accordance with the present invention.

Referring to FIG. 3, in some embodiments, the primary winding 14 includes a total number of primary winding turns ($N_P$), wherein the total number of primary winding turns ($N_P$) is split over multiple primary winding layers 14*a*, 14*b*, 14*c*, etc. The number of primary winding layers is represented by ($N_{layer}$). In some embodiments, each primary winding layer 14*a*, 14*b*, 14*c*, etc. includes the same number of primary layer turns. In some embodiments, the number of primary layer turns in each primary winding layer 14*a*, 14*b*, 14*c*, etc. is equal to ($N_P$) divided by ($N_{layer}$), or ($N_P/N_{layer}$). As seen in FIG. 3, in some embodiments each primary winding layer 14*a*, 14*b*, 14*c* is electrically connected in series.

Referring further to FIG. 3, in some embodiments the secondary winding 16 includes a plurality of secondary winding layers 16*a*, 16*b*, 16*c*, etc. Each secondary winding layer 16*a*, 16*b*, 16*c*, etc. generally includes a number of secondary layer turns ($N_S$). In some embodiments, each secondary winding layer 16*a*, 16*b*, 16*c*, etc. includes the same number of secondary layer turns ($N_S$). In some embodiments, as seen in FIG. 3, each secondary winding layer 16*a*, 16*b*, 16*c*, etc. is electrically connected in parallel. Additionally, each secondary winding layer can be connected in parallel and each secondary winding layer can include the same number of turns ($N_S$) in some embodiments. In some other embodiments, each secondary winding layer can be connected in parallel, but not include the same number of turns.

Figure 2:
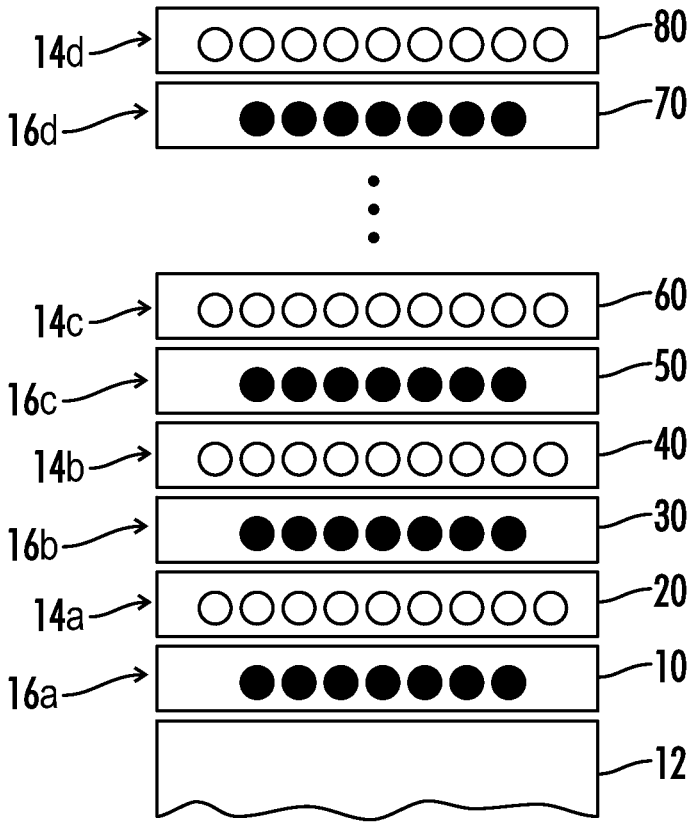
FIG. 2 is a partial exploded cross-sectional view of an embodiment of a transformer apparatus in accordance with the present invention.

Referring now to FIG. 2, in some embodiments, a plurality of winding layers is disposed about a bobbin structure 12. In an embodiment seen in FIG. 2, the first winding layer 10 positioned closest to the bobbin structure is a first secondary winding layer 16*a*. The second winding layer 20 is positioned adjacent the first winding layer 10 and is a first primary winding layer 14*a*. The third winding layer 30 is positioned adjacent second winding layer 20 and is a second secondary winding layer 16*b*. The fourth winding layer 40 is positioned adjacent the third winding layer 30 and is a second primary winding layer 14*b*. The fifth winding layer 50 is positioned adjacent the fourth winding layer 40 and is a third secondary winding layer 16*c*. The sixth winding layer 60 is positioned adjacent the fifth winding layer 50 and is a third primary winding layer 14*c*. Thus, in some embodiments, at least one of the plurality of primary winding layers 14*a*, 14*b*, 14*c*, etc. is positioned adjacent a secondary winding layer 16*a*, 16*b*, 16*c*, etc. In some embodiments, each primary winding layer is positioned adjacent a secondary winding layer.

In many applications transformer 100 can be used in a high voltage power supply circuit. In some applications, transformer 100 is a flyback transformer. In some embodiments, the total number of primary winding turns ($N_P$) is greater than the number of secondary winding turns ($N_S$). The total number of primary winding turns ($N_P$) in some embodiments is at least about two times greater than the number of secondary winding turns ($N_S$). In some embodiments, the ratio of the total number of primary winding turns ($N_P$) to the number of secondary winding turns ($N_S$) is greater than about ten.

Figure 4:
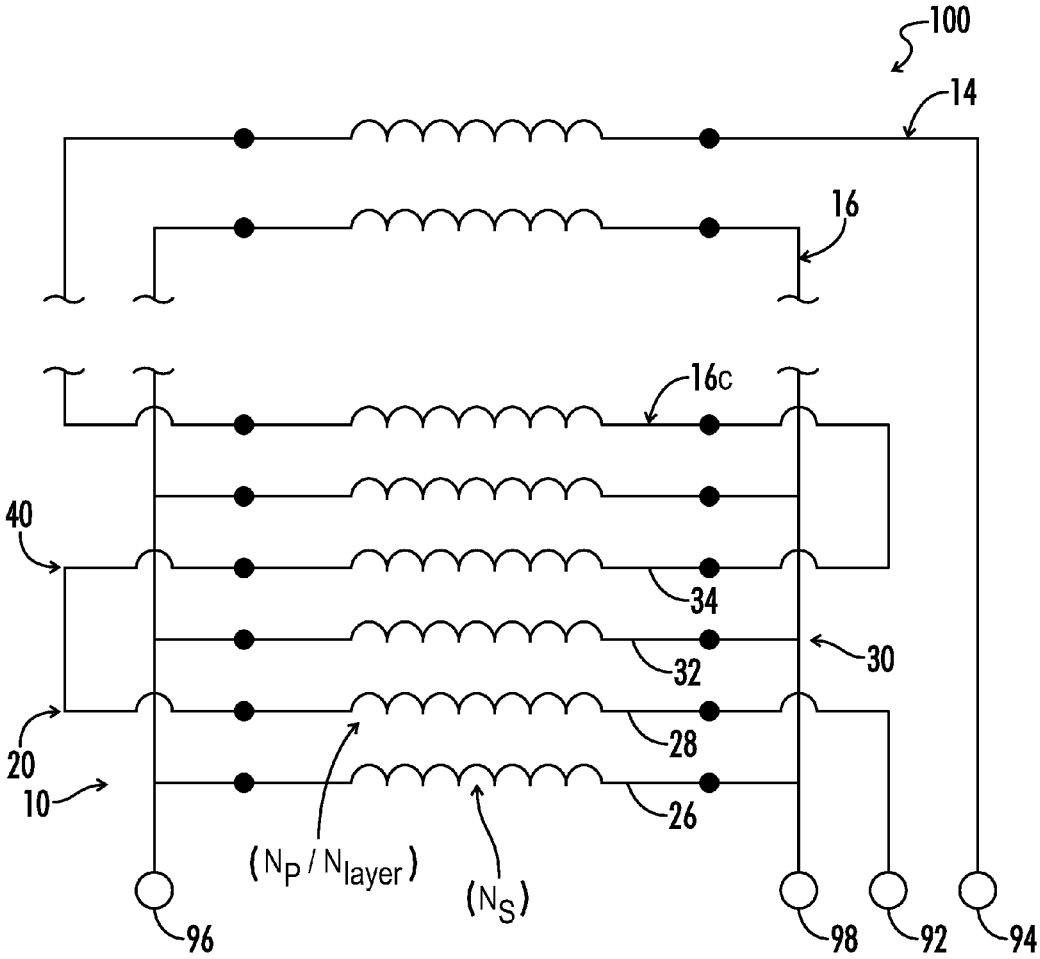
FIG. 4 illustrates a circuit diagram of an embodiment of a transformer apparatus in accordance with the present invention.

The winding configuration described above generally reduces leakage inductance in a transformer. In some applications, a further reduction in leakage inductance can be achieved by providing a transformer 100 with the number of primary layer turns ($N_P/N_{layer}$) equal to the number of secondary winding turns ($N_S$). In this embodiment, seen for example in FIG. 4, each primary winding layer includes the same number of primary layer turns ($N_P/N_{layer}$). Thus, in some embodiments, each layer 10, 20, 30, 40, etc. includes the same number of turns.

In some embodiments, the present invention provides a method of winding a transformer having a primary winding 14 including a total number of primary winding turns ($N_P$) and a secondary winding 16 with a number of secondary winding turns ($N_S$). The primary winding 14 includes ($N_{layer}$) primary winding layers 14*a*, 14*b*, etc. The method includes a step of winding a first conductive wire 26, seen in FIG. 4, a number of turns ($N_S$) around a coil former to form a first layer 10. The method also includes a step of winding a second conductive wire 28 a number of turns ($N_P/N_{layer}$) around the first layer 10 forming a second layer 20. In some embodiments, the method includes another step of winding a third conductive wire 32 a number of turns ($N_S$) around the second layer 20 forming a third layer 30. In some embodiments, the method includes an additional step of electrically connecting the first and third layers in parallel. In some embodiments, an additional step of the method includes winding a fourth conductive wire 34 a number of turns ($N_P/N_{layer}$) around the third layer 30 forming a fourth layer 40. Further, in some embodiments, the second layer 20 and the fourth layer 40 are electrically connected in series. In some embodiments of the method of winding a transformer, the number of turns ($N_S$) is equal to the number of turns ($N_P/N_{layer}$).

In a further embodiment, the present invention provides a method of winding a transformer that has a primary winding and a secondary winding. The primary winding includes a total number of primary winding turns ($N_P$), and the secondary winding has a total number of secondary winding turns equal to ($N_S$). The primary winding is divided into ($N_{layer}$) primary winding layers. The method includes the step of positioning alternating primary and secondary winding layers around a bobbin structure, wherein each primary winding layer includes ($N_P/N_{layer}$) primary layer turns, and each secondary winding layer includes ($N_S$) secondary layer turns. In some embodiments, the method further includes a step of electrically connecting each alternating primary winding layer in series. Additionally, in some embodiments, the method includes the step of electrically connecting each alternating secondary winding layer in parallel. Further, in some embodiments of the method the number of primary layer turns in each primary winding layer ($N_P/N_{layer}$) equals the number of turns in each secondary winding layer ($N_S$). Moreover, in some embodiments, the ratio of ($N_P$) to ($N_S$) is greater than about ten.

Thus, although there have been described particular embodiments of the present invention of a new and useful REDUCED LEAKAGE INDUCTANCE TRANSFORMER AND WINDING METHODS it is not intended that such references be construed as limitations upon the scope of this invention except as set forth in the following claims.

What is claimed is:

1. An electrical transformer comprising:

a core;

a primary winding wound around the core, the primary winding comprising a first number of primary winding layers, each primary winding layer comprising a second number of primary layer winding turns per layer, the primary winding turns in all of the plurality of primary winding layers electrically connected in series such that the primary winding has an effective total number of primary winding turns equal to the first number of primary winding layers times the second number of primary winding turns per layer; and a secondary winding wound around the core, the secondary winding comprising a third number of secondary winding layers, each secondary winding layer comprising a fourth number of secondary layer winding turns per layer, the secondary winding turns in all of the secondary winding layers electrically connected in parallel such that the effective number of turns of the secondary winding is equal to the fourth number of secondary winding turns per layer thereby providing a turns ratio of the primary winding to the secondary winding corresponding to the effective total number of primary winding turns divided by the fourth number of turns in each layer of the secondary winding, the secondary winding layers wound around the core interleaved with the primary winding layers to separate each secondary winding layer from an adjacent secondary winding layer by one of the primary winding layers and to separate each primary winding layer from an adjacent primary winding layer by one of the secondary winding layers.

2. The apparatus of claim 1, wherein:

each primary winding layer is wound on the core with the winding turns of each primary winding layer spaced along an axial winding length; and each secondary winding layer is wound on the core with the winding turns of each secondary winding layer spaced along the same axial winding length as each primary winding layer.

* * * * *